US005882239A

United States Patent [19]

Trichak

[11] Patent Number: 5,882,239

[45] Date of Patent: Mar. 16, 1999

[54] ILLUMINATABLE AERODYNAMIC DISC OR SAUCER

[76] Inventor: Angelique M. Trichak, 1035 Cobblers Crossing, Elgin, Ill. 60120

[21] Appl. No.: 897,002

[22] Filed: Jul. 18, 1997

[51] Int. Cl.[6] ..... A63B 65/10

[52] U.S. Cl. ..... 446/46; 446/219; 446/267; 473/570; 473/588

[58] Field of Search ..... 446/46, 47, 48, 446/219, 267; 473/570, 588, 589, 594, 224, 225; 273/DIG. 24

[56] References Cited

U.S. PATENT DOCUMENTS

| | | | |
|---|---|---|---|
| 3,351,347 | 11/1967 | Smith et al. | 473/570 |
| 4,015,111 | 3/1977 | Spector | 473/570 |
| 4,086,723 | 5/1978 | Strawick | 473/570 |
| 4,207,702 | 6/1980 | Boatman et al. | 446/48 |
| 4,254,575 | 3/1981 | Gould | 473/570 |
| 5,083,799 | 1/1992 | Thill | 473/588 |
| 5,348,509 | 9/1994 | Riccardi et al. | 446/46 |
| 5,536,195 | 7/1996 | Stamos | 446/48 |
| 5,683,316 | 11/1997 | Campbell | 473/570 |

*Primary Examiner*—Robert A. Hafer
*Assistant Examiner*—Jeffrey D. Carlson
*Attorney, Agent, or Firm*—Dillis V. Allen, Esq.

[57] ABSTRACT

An illuminatable plastic disc that spins and flies when thrown including chemiluminescent composition passages that extend radially across substantially the entire disc so when the disc spins in darkness, the entire disc appears illuminated. The chemiluminescent passages are formed integrally with the disc both in a two molding embodiment and in a single molding embodiment.

9 Claims, 2 Drawing Sheets

ILLUMINATABLE AERODYNAMIC DISC OR SAUCER

BACKGROUND OF THE INVENTION

Light emitting aerodynamic discs have been suggested in the past to enable disc throwing and catching during the dusk and even nighttime hours. These have included phosphorous light emitting coatings for the disc and more frequently have included discs that have receptacles for removably mounting chemiluminescent tubes. These tubes are fairly standard in construction and contain a flexible outer tube and an inner frangible wall that separates the tube into two compartments, each containing one of the chemiluminescent compositions that when mixed emit light for 4 or more hours depending upon the volume and strength of the chemiluminescent compositions.

One drawback with the plastic discs that have compartments to hold the removable chemiluminescent tubes is that they effect the aerodynamic properties of the discs and because the discs frequently are abused by hitting fixed objects, such as trees and buildings, the chemiluminescent tubes are likely to fall out of the discs.

A more significant problem in these prior flying discs that carry light emitting devices is that they do not illuminate the entire disc as it spins, and while this is not particularly significant for purposes of throwing the disc, it does interfere with catching the disc because the catcher cannot determine the location of the outer rim of the disc which is usually utilized for catching, as well as for throwing purposes.

A final comment on these prior illuminatable discs is that they are far too complicated and costly for the flying disc market.

The following is a list of United States Patents resulting from a prior art search:

| Inventor | Title of Patent | U.S. Pat. No. | Issued |
|---|---|---|---|
| Strawick | Chemi-luminescent Flying Saucer | 4,086,723 | 5/2/78 |
| Boatman, et al. | Light Transmissive Flying Saucer With Chemical Lightstick | 4,207,702 | 6/17/80 |
| Gould | Illuminated Flying Saucer-like Toys | 4,254,575 | 3/10/81 |
| Kuntnkay | Lighting Adapter Kit and Method For Installing Lights In A Flying Disc | 4,431,196 | 2/14/84 |
| Riccardi, et al. | Flying Disk Toy | 5,348,509 | 9/20/94 |
| Stamos | Illuminated Flying Disc | 5,536,195 | 7/16/96 |

The Boatman, et al., U.S. Pat. No. 4,207,702, shows a saucer-shaped toy that has a plurality of central clips 32 that hold a straight chemiluminescent light stick. In this design, the light stick can fall out of the disc and illuminates only a small central portion of the disc. The Strawick, U.S. Pat. No. 4,086,723, shows a design similar to Boatman, et al.

The Gould, U.S. Pat. No. 4,254,575, shows an aerodynamic flying saucer with a chemiluminescent ring tube that when positioned in an annular ring, fits within the disc. This configuration, when the chemiluminescent tube is activated and the disc is thrown, illuminates only a small part of the perimeter of the disc so that the disc appears as a thin lighted ring.

The Stamos, U.S. Pat. No. 5,536,195, shows an illuminated flying disc having a flexible chemiluminescent tube threaded through apertures in the top of the disc.

It is a primary object of the present invention to ameliorate the problems noted above in flying aerodynamic discs having chemiluminescent means for illuminating the disc.

SUMMARY OF THE PRESENT INVENTION

According to the present invention, an illuminatable aerodynamic plastic disc is provided that spins in flight when thrown including a plurality of chemiluminescent composition passages that extend radially across substantially the entire disc so that when the disc spins in darkness, the entire disc appears illuminated. The chemiluminescent passages are formed integrally with the disc eliminating the possibility of chemiluminescent tube disconnection from the disc during flight.

Toward these ends and in one embodiment, the radial chemiluminescent passages are formed between the disc and a spoked frame that snaps inside the disc.

In a second embodiment of the present invention, the chemiluminescent passages are formed entirely in the plastic molding for the disc by a plurality of slides in the injection mold for the disc.

Other objects and advantages of the present invention will appear more clearly from the following detailed description.

DETAILED DESCRIPTION OF THE PREFERRED EMBODIMENTS

Figure 1:
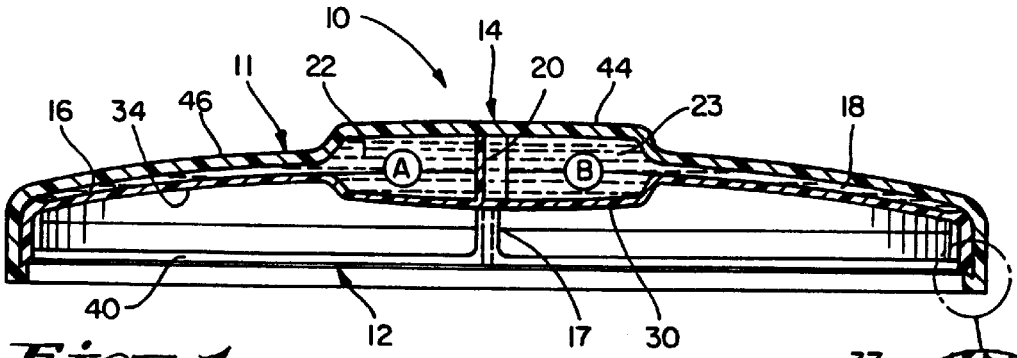
FIG. 1 is a cross-section through one embodiment of the present illuminatable aerodynamic disc.
Figure 2:
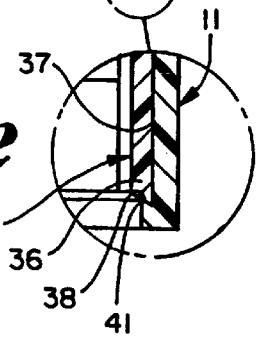
FIG. 2 is an enlarged fragmentary section showing the snap connection between the disc shown in FIG. 1 and the spoked insert.
Figure 3:
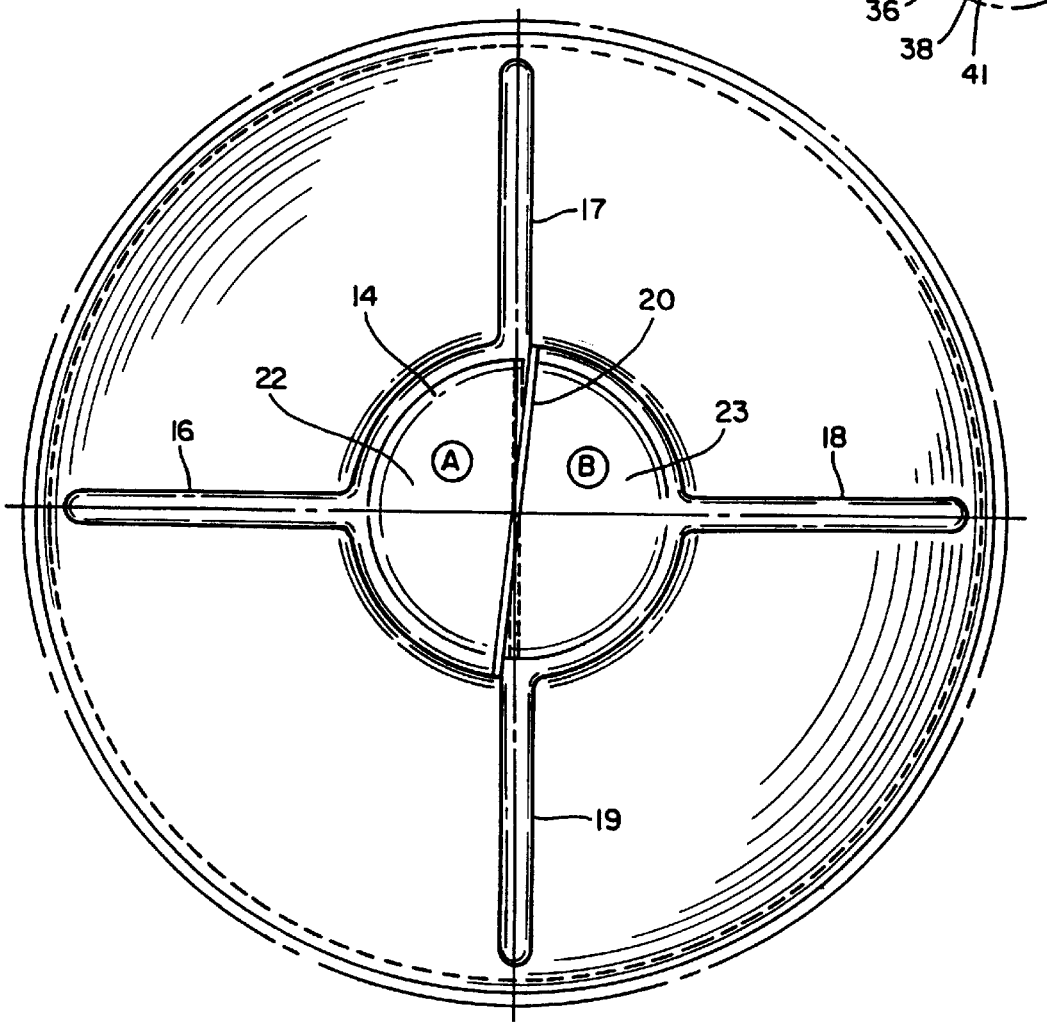
FIG. 3 is a top view of the present illuminatable aerodynamic disc illustrated in FIG. 1.

Referring to the drawings and particularly FIGS. 1 to 3, an illuminatable aerodynamic disc 10 is illustrated according to the present invention consisting of a primary disc molding 11 and a radially spoked snap-in insert 12 that cooperates with the molding 11 to form central chamber area 14 and communicating radial passages 16, 17, 18 and 19. The central circular chamber 14 has a rigid frangible wall 20 that separates chamber 14 into chamber portion 22 and chamber portion 23. Frangible wall 20 is canted as seen in the top view of FIG. 3 so that chamber portion 22, prior to the rupture of frangible wall 20, communicates with radial passages 16 and 17, while chamber portion 23, also prior to fracture of frangible wall 20, communicates with radial passages 18 and 19. Chamber portion 22 and radial passages 16 and 17 are filled with chemiluminescent composition A while chamber portion 23 and radial passages 18 and 19 are filled with chemiluminescent composition B, and these materials and the specific chemical formulas are well-known in the chemiluminescent art; for example, as disclosed in U.S. Pat. No. 3,597,362.

The insert 12 has a circular cup-shaped central portion 30 and four radial U-shaped upwardly opening integral spoke portions 34 that form the passages 16, 17, 18 and 19. The spoke portions 34 have a downwardly curving rim portion 36 complimentary to top molding rim wall 37, and are connected together at their ends by a circular portion 40, as shown in FIG. 1, that snaps into an undercut shoulder 38 and extends entirely around the perimeter of the inside of rim wall 37.

The downwardly extending portions 36 of each of the four spokes are integral with the annular ring portion 40, and it has a frusto-conical surface 41 on its lower edge that snaps into shoulder 38 to retain the insert 12 permanently inside of the primary disc molding 11. Each of the spoke portions 34 is heat sealed to a lower surface of a primary molding 11 to seal the passages 16, 17, 18 and 19 with the chemiluminescent fluid therein. Suitable means are provided for injecting the chemiluminescent material into the chamber portions 22 and 23 and the radial passages 16, 17, 18 and 19 after the insert is snapped and bonded into the primary disc molding 11.

The primary disc molding 11 has a downwardly opening central cup portion 44 that merges into a slightly downwardly curving annular wall portion 46 that merges into downwardly depending rim wall 37.

An important aspect of the present invention is that the passages 16, 17, 18 and 19, along with the central chambers 22 and 23, extend diametrally across the primary molding 11 over 90% of the diameter of molding 11. In this way almost the entire disc 10 is illuminated as it is spun.

The chemiluminescent parts A and B are intermingled by the user by bending the assembly and fracturing the wall 20 to mix parts A and B.

Figure 4:
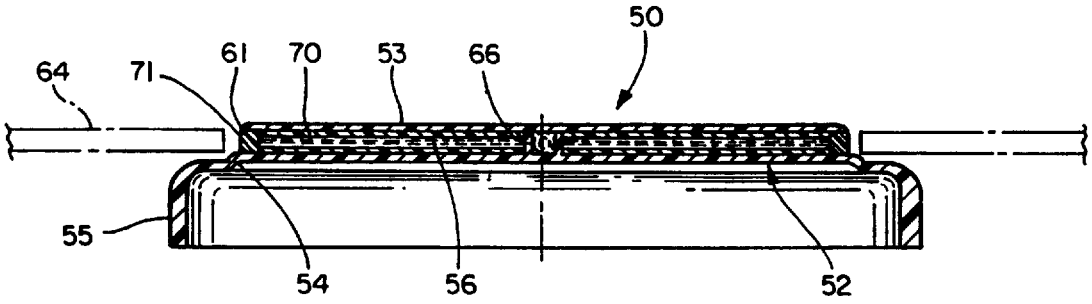
FIG. 4 is a cross-section through an illuminatable aerodynamic disc according to another embodiment of the present invention.
Figure 5:
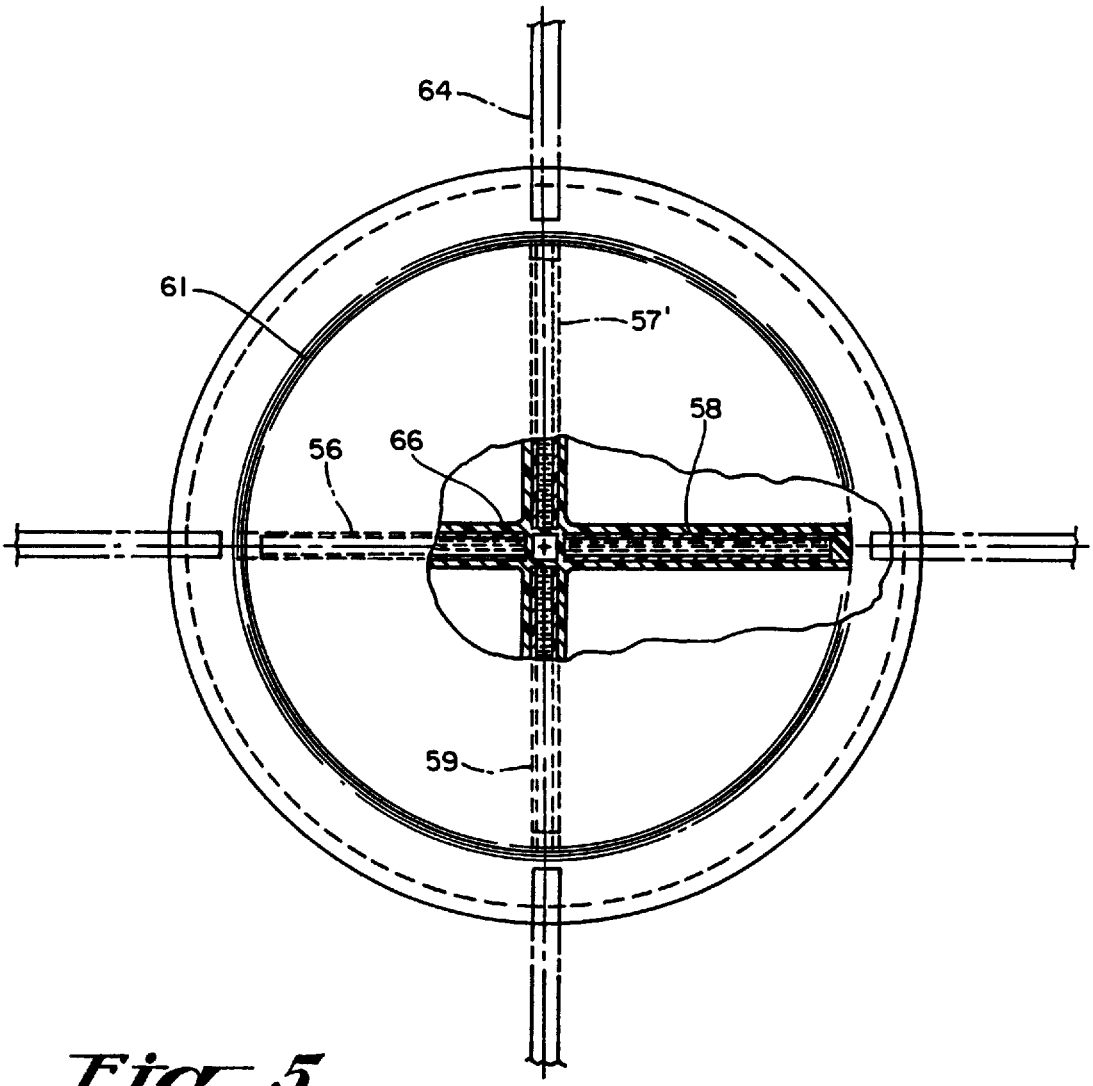
FIG. 5 is a partly broken away top view of the illuminatable aerodynamic disc illustrated in FIG. 4, superimposed by fragmented slides that form the chemiluminescent passages.

Viewing FIGS. 4 and 5, in which a second embodiment is disclosed, an illuminatable aerodynamic disc 50 is shown that is a one-piece plastic injection molding 52. The molding 52 has a circular central portion 53, a very short downwardly and outwardly converging S-shaped annular wall 54, and an integral downwardly depending rim wall 55.

A plurality of radial passages 56, 57, 58, and 59 are formed through the vertical annular side wall 61 of the molding central portion 53 by four radial slides 64. They are illustrated in FIGS. 4 and 5 to disclose how the passages are formed. In actuality, slides 64 are part of the injection molding tool for the one-piece disc molding 52.

The passages 56, 57, 58 and 59 each have end walls 66 that are formed by the ends of the slides; i.e., in their extended positions.

Each of the passages 56, 57, 58 and 59 is adapted to receive a chemiluminescent frangible tube 70 that is permanently held in position by a heat sealed plug 71 closing the open end of the passages. Each of the tubes 70 contain both Part A and Part B and a frangible wall, although not illustrated in detail in FIG. 4. Alternatively, the passages 56, 57, 58 and 59 can receive the chemiluminescent fluids directly without separate tubes 70, and in this event the separating walls 66 can be designed in frangible fashion to mix the chemicals.

It is claimed:

1. A single illumination aerodynamic saucer, comprising: generally annular plastic saucer having a generally flat disc portion having a central axis of rotation and a downwardly turned rim portion extending from the flat disc portion, said saucer being defined in part by a top wall and a substantially parallel bottom wall in part spaced from the top wall, and illumination means for illuminating substantially the entire saucer as it spins through the air including means forming a passage between the saucer top wall and the substantially parallel spaced in part bottom wall extending from the central axis of rotation outwardly substantially to the downwardly turned rim portion so the means forming the passage has the shape of the saucer and does not diminish saucer aerodynamics, a frangible dividing wall in the passage means formed integrally with one of the top wall and bottom wall, and chemiluminescent composition portions in the means forming the passage on the opposite sides of the frangible wall.

2. A single illumination aerodynamic saucer as defined in claim 1, wherein the generally circular plastic saucer top wall includes a top molding with a central disc portion and a downwardly turned rim portion, said plastic saucer bottom wall also including a separate bottom molding having substantially the same diameter as the top molding that snap locks inside the top molding, said top molding and bottom molding cooperating to form the means forming a passage.

3. An illuminatable aerodynamic saucer as defined in claim 1, wherein the passage means includes at least two radially extending passages extending from the axis of rotation.

4. A single illumination aerodynamic saucer as defined in claim 1, wherein the circular plastic saucer is a one-piece plastic molding and the means forming a passage is in the one-piece plastic molding without the need for separate parts.

5. A single illumination aerodynamic saucer as defined in claim 2, wherein the means forming the passage includes a circular central chamber on the axis of rotation and a plurality of communicating radial passages extending outwardly from the central chamber.

6. A single illumination aerodynamic saucer, comprising: a one-piece plastic molding having a central disc portion and a downwardly depending rim portion, said one piece molding having a top wall and a substantially parallel bottom wall with portions thereof spaced downwardly from the top wall, means forming an integral narrow diametral passage in the one-piece plastic molding between the top wall and the substantially parallel bottom wall at the spaced portions so the means forming the passage has the same cross sectional shape as the saucer, frangible walls formed integrally with one of the top wall and bottom wall, and chemiluminescent compositions in the means forming the passage.

7. An illuminatable aerodynamic saucer as defined in claim 6, wherein the passage means is a plurality of radially extending passages in the one-piece plastic molding.

8. An illuminatable aerodynamic saucer as defined in claim 6, wherein the passage means is adapted to illuminate substantially the entire saucer by extending from a central axis of rotation to the downwardly depending rim portion.

9. An illuminatable aerodynamic saucer as defined in claim 6, wherein the passage means is adapted to receive insertable chemiluminescent tubes.

* * * * *